US005349131A

United States Patent [19]

Sotani et al.

[11] Patent Number: 5,349,131

[45] Date of Patent: Sep. 20, 1994

[54] ELECTRICAL WIRING MATERIAL AND TRANSFORMER

[75] Inventors: Junji Sotani, Yokohama; Kuniyoshi Satoh, Tokyo; Hajima Noda, Icihara, all of Japan

[73] Assignee: Furukawa Electric Co., Ltd, Tokyo, Japan

[21] Appl. No.: 906,375

[22] Filed: Jun. 30, 1992

[51] Int. Cl.[5] ..... H01B 5/00; H01F 27/28

[52] U.S. Cl. ..... 174/24; 29/860; 29/861; 174/74 R; 174/94 R; 336/198; 361/699; 439/883; 439/884; 439/889

[58] Field of Search ..... 174/24, 94 R, 94 S, 174/74 R; 361/385; 29/860, 861; 336/198; 439/883, 885, 889, 884

[56] References Cited

U.S. PATENT DOCUMENTS

| | | | |
|---|---|---|---|
| 1,631,719 | 6/1927 | Chandler | 174/94 R |
| 2,138,617 | 11/1938 | Scott, Jr. | 174/24 |
| 2,906,987 | 9/1959 | Fox, Jr. | 174/94 R |
| 3,296,577 | 1/1967 | Travis et al. | 174/94 R |
| 3,443,256 | 5/1969 | Holtox et al. | 174/94 R |
| 3,517,730 | 6/1970 | Wyatt | 174/15.2 |
| 3,561,525 | 2/1971 | Baer | 174/15.2 X |
| 3,563,309 | 2/1971 | Basiulis | 174/15.2 X |
| 3,566,465 | 3/1971 | Weiner | 174/94 R |
| 3,700,028 | 10/1972 | Noren | 174/15.2 X |
| 3,829,740 | 8/1974 | Beasley | 174/15.2 |
| 3,861,780 | 1/1975 | Hobbs II | 439/883 X |
| 3,945,709 | 3/1976 | Filson | 439/883 X |
| 4,617,543 | 10/1986 | Akachi et al. | 336/198 X |
| 4,857,877 | 8/1989 | Dethienne | 336/198 X |
| 4,890,085 | 12/1989 | Saito et al. | 336/198 X |

FOREIGN PATENT DOCUMENTS

| | | | |
|---|---|---|---|
| 1390908 | 4/1975 | United Kingdom | 174/15.2 |

*Primary Examiner*—Morris H. Nimmo
*Attorney, Agent, or Firm*—Thomas R. Morrison

[57] ABSTRACT

An electrical wiring material having a cooling function is characterized by a long hollow conductive body within which operating fluid is internally confined. An electrical connection piece is provided at the end portions of the conductive body, or other portions thereof. When used to wire electronic apparatuses, resulting heat is radiated due to evaporation and condensation of the operating fluid within the hollow conductive body. The wiring material may be used to wind a transformer, particularly the low voltage side, to provide a self cooling transformer.

14 Claims, 7 Drawing Sheets

ELECTRICAL WIRING MATERIAL AND TRANSFORMER

BACKGROUND OF THE INVENTION

This invention relates to an electrical wiring material and a transformer which uses the electrical wiring material, and more particularly to such an electrical wiring material that can also be used as cooling means for portions of electronic apparatuses that produce heat and a transformer having a coil of one side also serving as the cooling means.

No proposals have been made with reference to any electrical wiring materials also serving as cooling means for parts producing heat or any transformers having coils also serving as the cooling means.

On the other hand, it is known in the prior art to use a heat pipe having a small diameter as cooling means for transformers, large scale integration, integrated circuit (hereinafter LCI and IC respectively) and other parts subject to heating in electronic apparatuses packaged with electronic components at high density.

In general, in order to cool heating parts using a heat pipe, the heat pipe is appropriately positioned by appropriate means so as to bring a portion of the heat pipe into a contact with the surface of the heating part. The heat of the heating part is removed by evaporating the operating fluid within the heat pipe at a contact portion between the heat pipe and the heating part. Consequently, the heat is radiated by condensing the vapor of the operating fluid at the other portion of the heat pipe.

One of the issues in the prior art is the fact that a cooling effect is influenced by a contact area between the heating part and the heat pipe. In particular, the contact area between the heating part and the heat pipe having a small diameter is extremely limited.

Another issue in the prior art is the fact that the cooling effect is reduced by a thermal resistance of the contact portion between the heat pipe and the heating part, which depends on the property of the heat pipe.

A further issue in the prior art is the fact that an apparatus thereof is large-sized as a whole, since an installation space for the heat pipe itself is effective required for effective cooling.

Each issue of this kind is also encountered the in where case to be a transformer loaded on the apparatus is cooled as well.

An object of the present invention is to provide an electrical wiring material which does not need any special cooling means for cooling a heating part by using the electrical wiring material for a mutual electrical connection between the parts in an electronic apparatus and, which consequently, contributes to the miniaturization of the apparatus.

Another object of the present invention is to provide an electrical wiring material which provides superior contact area between the heating portion and the cooling means and a contact thermal resistance thereof even when a large current flows through an electric circuit to generate heat, and consequently, which can radiate the heat by itself.

A further object of the present invention is to provide a transformer which does not need any other means for cooling by having a self-cooling effect.

OBJECTS AND SUMMARY OF THE INVENTION

For attaining the above-mentioned objects, an electrical wiring material according to the present invention comprises a long and hollow conductive body, into which operating fluid is sealed.

Any kinds of material having good conductivity may be used in producing the hollow conductive body, but generally, copper or its alloys is used.

It is desirable that an electrical connection piece is provided at the end portion of the above-mentioned hollow conductive body or another arbitrary portion thereof. This electrical connection piece may be formed as part of the hollow conductive body itself or it may be attached to the hollow conductive body. The design of the electronic apparatus and the configuration of its parts determines placement of the electrical connections piece on the hollow conductive body.

It is preferable that a portion of the hollow conductive body is crushed flat so as to form a flat portion and the above-mentioned electrical connection piece is processed to this flat portion or attached thereto. It is further preferable that stitch-like, folded or any other irregularities are formed on one surface or both surfaces of this flat portion.

The entire portion or a portion of the above-mentioned hollow conductive body except the portion of the electrical connection piece can be arranged with an insulating covering or attached with a cooling body, if necessary.

The shape of the above-mentioned hollow conductive body in cross section is not particularly restricted. Generally, a cylindrical shape is preferable, however the entire portion or a portion of the hollow conductive body may also be formed rectangularly in cross section or in an ellipsoidal shape in accordance with its necessity.

Furthermore, it is desirable that a wick is provided in the internal portion of the above-mentioned hollow conductive body.

For attaining the preceding objects, in accordance with the present invention, a transformer utilizes an electrical wiring material constituted by a long and hollow conductive body, into which operating fluid is sealed, for winding a coil on the lower voltage side.

It is desirable that an electrical connection piece is provided at a suitable position or a cooling body is installed thereto, in the portion other than the coil winding portion of the preceding electrical wiring material. It is also desirable that a wick is provided within the hollow conductive body constituting this electrical wiring material.

Since the electrical wiring material in accordance with the present invention is constituted as described above, in case the electrical wiring material is wired so as to position it partially at the heating portion in an electronic apparatus and to position the rest portion thereof at a comparatively low temperature portion, the operating fluid within the internal portion evaporates at the heating portion to remove the heat of the heating portion, and the heat can be radiated due to the fact that the resulting vapor is transferred to another portion and condensed. Consequently, the electronic apparatus provides its own cooling function without need for any other special cooling means.

In addition, the electrical wiring material in accordance with the present invention is preliminarily embedded in the distributing board of an apparatus so as to position a portion of the electrical wiring material at a high temperature generating portion of the board and to position the other portion thereof at a comparatively low temperature portion. By so doing, it can produce a distributing board having a self contained cooling function.

Furthermore, according to the electrical wiring material of the present invention, any overheating can be prevented by the self-cooling effect, even though a large current may flow through a wiring.

Since the transformer in accordance with the present invention is constituted as described above, due to a coil itself on a low voltage side in which a large current flows, the heat generated in the coil can be radiated. Consequently, no other cooling means is needed to the transformer or it may be enough by installing with extremely small capacity cooling means.

DETAILED DESCRIPTION OF THE PREFERRED EMBODIMENT

Referring now to attached drawings, the present invention will be explained more specifically as follows.

Figure 1:
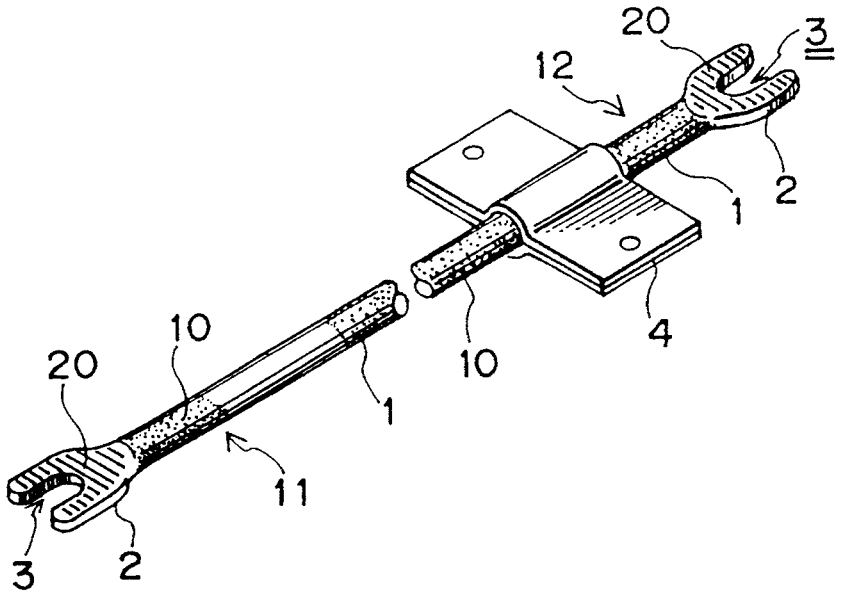
FIG. 1 is a fragmentary perspective view showing an electrical wiring material as a preferred embodiment of the present invention.
Figure 2:
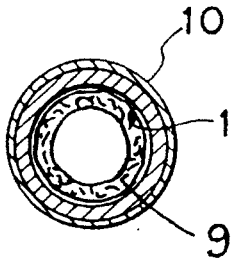
FIG. 2 is an enlarged sectional view showing the electrical wiring material of FIG. 1.

In FIG. 1, reference numeral 1 indicates a hollow conductive body which has an internal portion formed with a fine wick 9, as illustrated in cross-section in FIG. 2 and is made of a copper pipe with 3 mm in outer diameter and 200 mm in length.

After one end portion of this hollow conductive body 1 is sealed and simultaneously formed into a flat portion 2 by welding using an ultrasonic welding method, the internal portion thereof is deaerated and injected with approximately 10% to 20% operating fluid 13 (water in this embodiment). The other end portion is then sealed and simultaneously formed into another flat portion 2 by welding using an ultrasonic welding method. The flat portions 2, 2 of both ends are processed by chipping or pressing into a bifurcated electrical connection piece 3.

As described above, folded irregularities 20 are formed on both surfaces of the flat portion 2 of the sealed end. The width (the length of the irregularity 20 in its folded direction) of each flat portion 2 formed as described above is 5 mm through 6 mm and the length thereof is about 7 mm, respectively.

An insulating covering 10 is provided on a portion, excluding the portion of the preceding electrical connection piece 3 of the hollow conductive body 1 by coating or other appropriate means. A radiation plate 4 is mounted on a portion of this insulating covering 10, as shown in FIGS. 1 and 2.

The electrical wiring material in the preceding embodiment is used for connecting IC, LSI and other parts to one another mainly in electronic apparatuses. In applications where one portion 11 of the hollow conductive body 1 is positioned at a heating portion, the other portion 12 is positioned at a comparatively low temperature portion and the radiation plate 4 is connected to an unshown chassis of an electronic apparatus, the heat at the heating portion is removed by the evaporation of the operating fluid within one portion 11 of the hollow conductive body 1. The resulting vapor moves to the other portion 12 of the hollow conductive body 1 and the heat is radiated due to the cooling and condensation of the vapor at the portion 12, resulting in the cooling of the heating portion.

In addition, the electrical wiring material of the preceding embodiment may be preliminary embedded in a distributing board with one portion 11 of the hollow conductive body 1 positioned at the portion to be loaded with a part generating high heat, and the radiation plate 4 is exposed to a comparatively low temperature portion when the distributing board is produced. In this way, the distributing board is cooled by the action of the electrical wiring material when the board packaged with various elements is incorporated into an apparatus and interconnected by the electrical wiring material.

Furthermore, by use of this electrical wiring material, over heating of the wiring portion may be prevented by its own self-cooling action, even though a large current may flow through the circuit.

Consequently, where the electrical wiring material in the preceding embodiment is used, a required portion of an apparatus may be cooled without mounting any special cooling means. Thus, miniaturization of apparatuses can be accomplished, since special cooling means are not required. At the same time, the degree of freedom for designing the apparatus is enhanced.

In the electrical wiring material of the preceding embodiment, following the step in which the portion formed with the electrical connection piece 3 is processed into the flat portion 2 and this flat portion 2 is processed by forming the irregularity 20, this portion is strengthened by processing and hardening. This provides added strength, and prevents the electrical connection piece 3 from being easily broken or cut off, even though the electrical connection piece 3 may stressed by external forces.

Instead of being processed as described above, the flat portion 2 in the hollow conductive body 1 may be subjected to Tig welding or Mig welding by crushing the end portion of the hollow conductive body 1 with an unshown suitable caulking jig.

The irregularity 20 on the surface of the flat portion 2 can be formed in a stitch-like or any other form rather than a folded form as illustrated.

As for the operating fluid in the hollow conductive body 1, water, Freon and other operating fluids operating stably in the temperature range of a predetermined target may be used.

Figure 3:
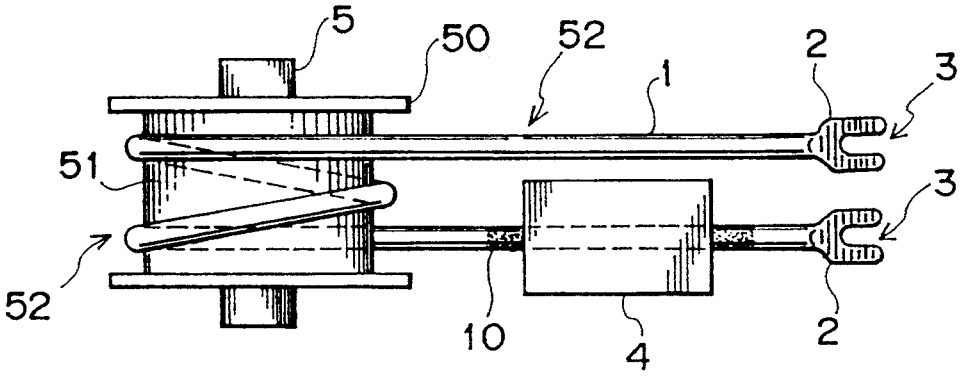
FIG. 3 is a schematic front view showing an electrical wiring material as another embodiment of the present invention and a transformer as a preferred embodiment of the present invention.

FIG. 3 shows an embodiment of an electrical wiring material of the present invention and a transformer using the same. Reference numerals 5 and 50 indicate an iron core and a spool, respectively. 51 indicates a high voltage side coil densely rolled around the spool 50 and externally covered with an insulating covering, and 52 indicates a low voltage side coil externally rolled thereon, respectively.

In the low voltage side coil 52, an unshown fine wick (groove) equivalent to fine wick 9 of the previous embodiment as shown in FIG. 2 which is 2 mm in outer diameter and 1.4 mm in inner diameter is internally formed and an electrical wiring material constituted by a hollow conductive body 1 made of a cylindrical long copper pipe is used. A proper amount of operating fluid is sealed in the preceding hollow conductive body 1.

Both end portions of this hollow conductive body 1 are processed into flat portions 2 similar to the electrical wiring material of the embodiment in FIG. 1, and each flat portion 2 is processed into a bifurcated electrical connection piece 3.

Radiation plate it is mounted at a position closer to one end portion of the hollow conductive body 1 through the insulating covering 10.

The transformer of the embodiment shown in FIG. 3, generates high heat when a large current is passed through the low voltage side coil 52. However, since the coil 52 is wound with the hollow conductive body 1 in which operating fluid 13 is sealed as described above, the heat is radiated by the coil 52 itself. Consequently, there is no need for any other special cooling means due to the fact that the transformer itself is self-cooled.

Figure 4:
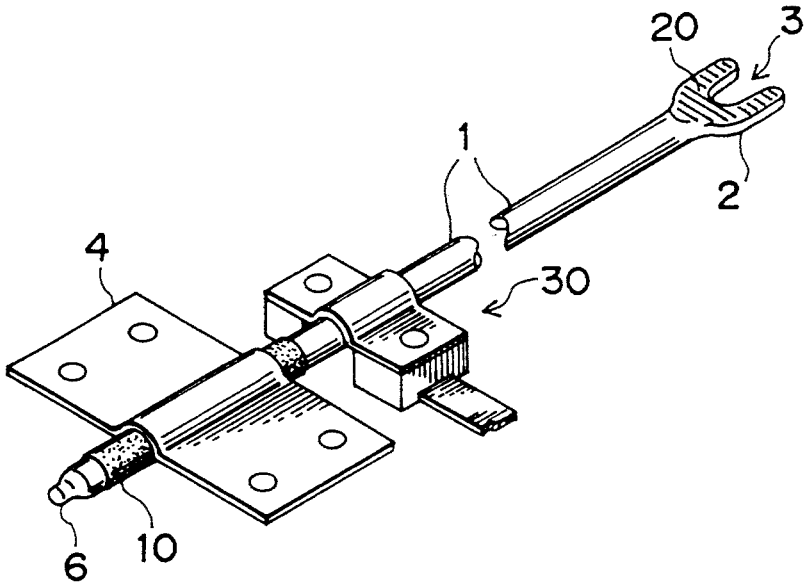
FIG. 4 is a fragmentary perspective view showing an electrical wiring material as a further embodiment of the present invention.

FIG. 4 shows an electrical wiring material of a further embodiment. At one end of a hollow conductive body 1 made of a copper pipe with a small diameter, a flat portion 2 is formed which has the irregularity 20 on a surface thereof similar to the electrical wiring material shown in FIG. 1, and this flat portion 2 is processed into a bifurcated electrical connection piece 3.

The hollow conductive body 1 is deaerated and a proper amount of operating fluid is sealed therein. At same the time, a seal portion 6 is formed by welding at the other end portion to seal the hollow conductive body, and an electrical connection piece 30 is mounted at the position slightly apart from the preceding seal portion 6 of the hollow conductive body 1. Furthermore, the radiation plate 4 is mounted on the hollow conductive body 1 through the insulating covering 10 composed of thermal shrinkage tube over the portion between this electrical connection piece 30 and the seal portion 6.

When the electrical connection piece 30 at the end portion of the hollow conductive body 1 is positioned at the heating portion of an unshown apparatus and the radiation plate 4 is connected to a comparatively low temperature portion of the chassis in the unshown apparatus, the heat at the preceding heating portion is radiated by the action of the operating fluid in the hollow conductive body 1.

Since other features and actions of the electrical wiring material shown in FIG. 4 are similar to those of the electrical wiring material shown in FIG. 1, further explanation thereof is unnecessary.

Figure 5:
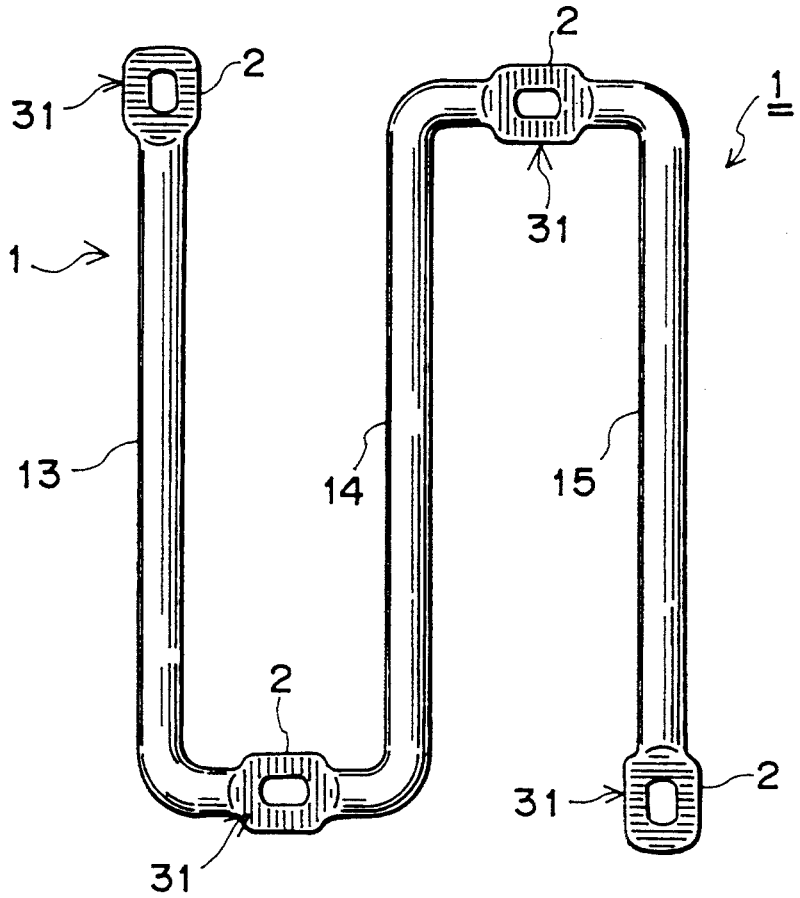
FIG. 5 is a plan view showing an electrical wiring material as a still further embodiment of the present invention.

In an electrical wiring material of an embodiment shown in FIG. 5, at both ends of a hollow conductive body 1 made of a long copper pipe with a small diameter and proper locations between both ends thereof, a flat portion 2 similar to that of the electrical wiring material in FIG. 1 is formed. The flat portions 2 at these four places are processed into annular electrical connection pieces 31, respectively.

A proper amount of operating fluid is sealed in the hollow conductive body 1, but the hollow portions 13, 14 and 15 among the electrical connection pieces 31 are independent of one another.

With reference to the electrical wiring material of FIG. 5, when used for the wiring of apparatuses, each of the hollow conductive portions 13, 14 and 15 in the hollow conductive body 1 may act as a cooling means. Furthermore, in either the neighboring hollow portions 13 and 14 or 14 and 15, when one pair is heated, the other of the pair can become a radiation portion.

Since other features and actions of the electrical wiring material of the embodiment shown in FIG. 5 are almost similar to those of the electrical wiring material of the embodiment shown in FIG. 1, any further explanation thereof is unnecessary.

Figure 6:
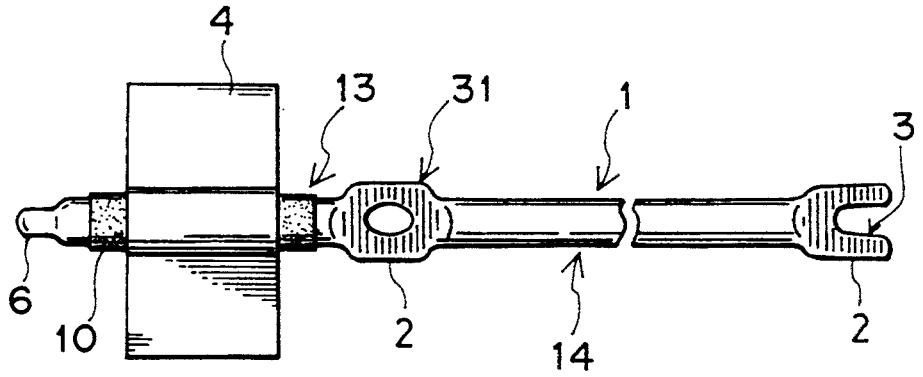
FIG. 6 is a plan view showing an electrical wiring material as a yet further embodiment of the present invention.

With reference to an electrical wiring material of an embodiment shown in FIG. 6, an annular electrical connection piece 31 is processed instead of having the electrical connection piece 30 mounted on the hollow conductive body 1 of the electrical wiring material shown in FIG. 4. Other portions are of structure similar structure to those of the electrical wiring material shown in FIG. 4.

In the electrical wiring material shown in FIG. 6, each of the hollow portions 13 and 14 divided by the electrical connection piece 31 in the hollow conductive body 1 is independent. In this embodiment a one hollow portion 14 acts as a self-cooling means for itself, and further, the other hollow portion 13 becomes a radiation portion for one hollow portion 14.

Other actions of the electrical wiring material in this embodiment are similar to those of the electrical wiring material shown in FIG. 4, and therefore, any further explanation thereof is unnecessary.

Figure 7:
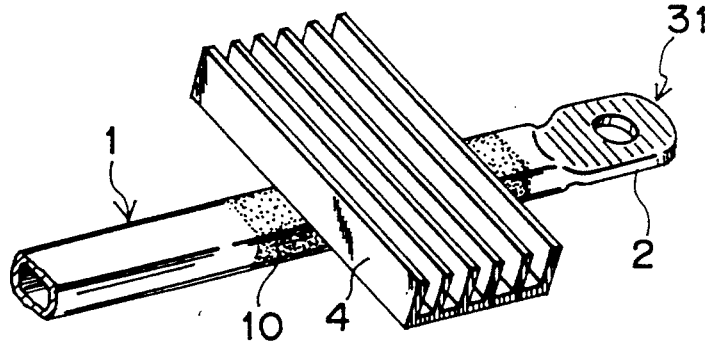
FIG. 7 is a fragmentary perspective view showing an electrical wiring material as a yet further embodiment of the present invention.

In an electrical wiring material of an embodiment shown in FIG. 7, a hollow conductive body 1 made of a sectional rectangular copper pipe having 1.7 mm in short outer diameter and 3 mm in long outer diameter is used. An unshown wick is formed in the hollow conductive body 1, and a proper amount of operating fluid is sealed therein. Both ends of the hollow conductive body 1 are enclosed and welded by an ultrasonic welding method and formed in a flat portion 2, respectively. This flat portion 2 is processed into the annular electrical connection piece 31, and the radiation plate 4 is partially mounted through the insulating covering 10.

Figure 8:
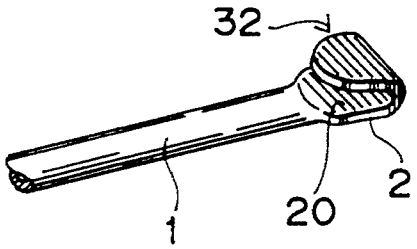
FIGS. 8 through 11 are fragmentary perspective views showing electrical connection pieces in electrical wiring materials as modifications of the present invention, respectively.
Figure 9:
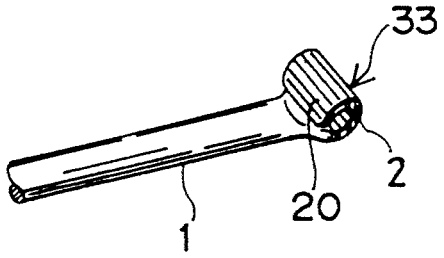

The electrical wiring material shown in FIG. 7 is preferable for embedding preliminarily in an unshown distributing board, since a flat hollow conductive body 1 is used. Since other actions and effects are similar to those of the electrical wiring material in FIG. 1, any further explanation thereof will be omitted. In addition to the preceding shape, an electrical connection piece 32 having flat portion 2 may be formed on the hollow conductive body 1, processed in a hook, form as shown in FIG. 8. An electrical connection piece 33 having a flat portion 2 formed on the hollow conductive body 1 may also be processed in a cylindrical form as shown in FIG. 9.

Figure 10:
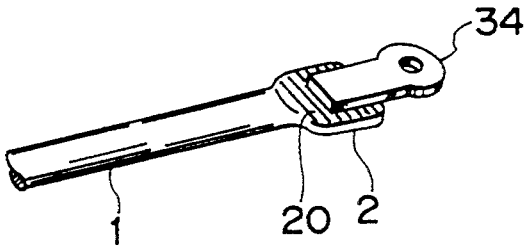
Figure 11:
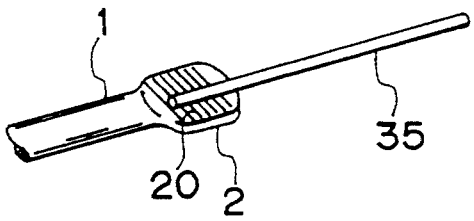

Also, an electrical connection piece 34 having an annular, hooked, bifurcated or any other form and mounted on a flat portion 2 formed on the hollow conductive body 1 as shown in FIG. 10 may be used. These electrical connection pieces 34 can further be replaced with such an electrical connection piece 35 as shown in FIG. 11.

Figure 12:
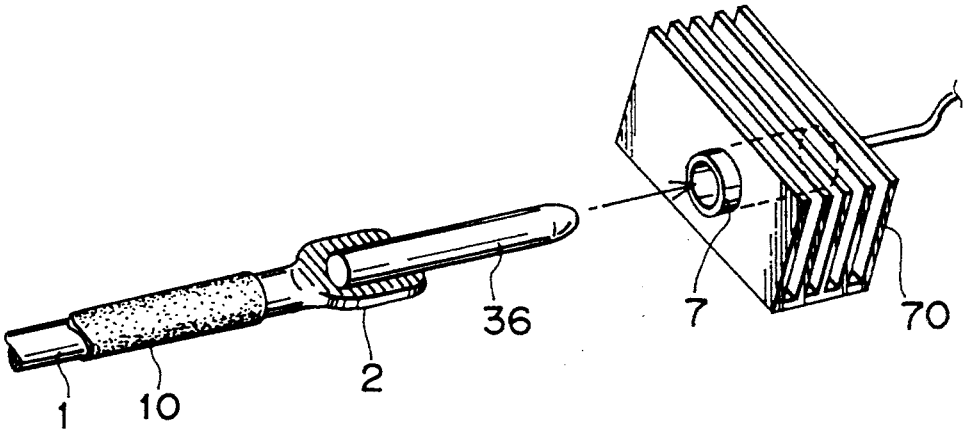
FIG. 12 is a fragmentary perspective view showing an electrical connection piece in an electrical wiring material as another modification of the present invention.

FIG. 12 shows another modification of the electrical connection piece. An end portion of a long hollow conductive body 1 made of a copper pipe is welded and sealed by an ultrasonic welding method to form a flat portion 2. A pin-like electrical connection piece 36 in the form of connector is welded to this flat portion 2 so as to be connected by inserting this electrical connection piece 36 into a pipe-like connector 7. This connector 7 is fixed to a radiation plate 70 supported to the chassis of an unshown apparatus, and the heat of the hollow conductive body 1 is radiated more effectively by this radiation plate 70.

Figure 13:
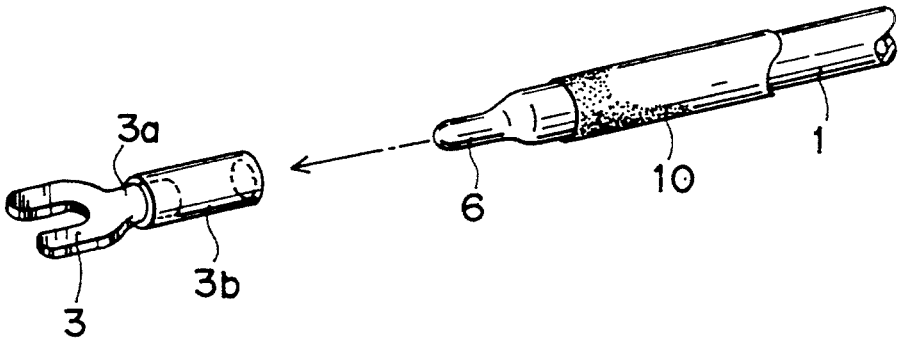
FIG. 13 a fragmentary exploded perspective view showing installation means for an electrical connection piece as another embodiment in an electrical wiring material of the present invention.
Figure 14:
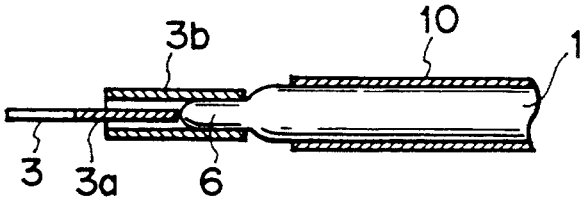
FIG. 14 is a sectional view showing an end portion of the electrical wiring material of FIG. 13.

FIGS. 13 and 14 show other embodiments of the installing means for installing the electrical connection pieces to the end portion of the hollow conductive body 1. An electrical connection piece 3 is mounted on the end portion of the hollow conductive body 1 by engaging a connector 3*b* made of a short copper pipe with a seal portion 6 having a small diameter at the end portion of the hollow conductive body 1. A base 3*a* of the bifurcated electrical connection piece 3 is then inserted into the end portion of this connector 3*b* which is then slightly caulked to the connector 3*b*.

Figure 15:
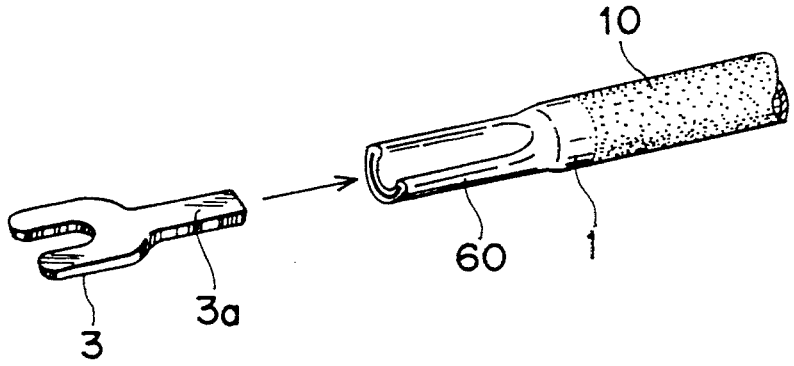
FIG. 15 is a fragmentary exploded perspective view showing installation means for an electrical connection piece as a further embodiment in an electrical wiring material of the present invention.

FIG. 15 shows a further embodiment of the means for installing the electrical connection piece to the end portion of the hollow conductive body 1. The electrical connection piece 3 is mounted on the end portion of the hollow conductive body 1 by guiding the base 3*a* of the bifurcated electrical connection piece 3 to a short channel-like seal portion 60 formed at the end portion of the hollow conductive body 1 and then welding the seal portion 60 to the base 3*a*.

The electrical connection pieces 3 shown in FIGS. 13 through 15 are in bifurcated form as illustrated, but may nevertheless be replaced with those of other shapes.

Figure 16:
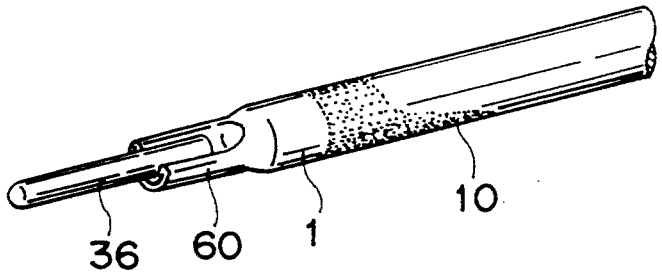
FIG. 16 is a fragmentary perspective view showing installation means for an electrical connection piece as a still further embodiment in an electrical wiring material of the present invention.

FIG. 16 shows a still further embodiment of the means for installing the electrical connection piece to the end portion of the hollow conductive body 1. The pin-like electrical connection piece 36 in the form of a connector is guided into the short channel-like seal portion 60 formed at the end portion of the hollow conductive body 1 and welded thereto.

Figure 17:
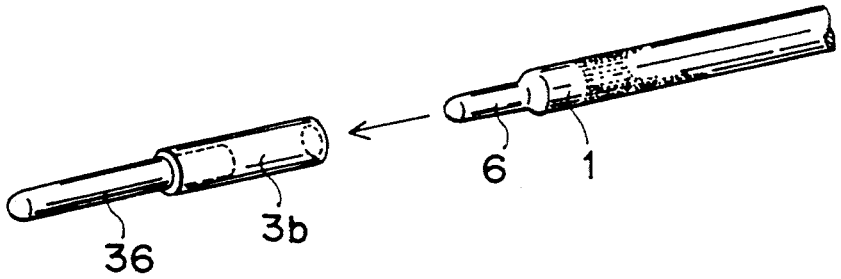
FIG. 17 is a fragmentary exploded perspective view showing installation means for an electrical connection piece as a yet further embodiment in an electrical wiring material of the present invention.

FIG. 17 shows a yet further embodiment of the means for installing the electrical connection piece to the end portion of the hollow conductive body 1. The pin-like electrical connection piece 36 in the form of a connector is connected to the short seal portion 6 with a small diameter formed at the end portion of the hollow conductive body 1 by means of the connector 3*b* composed of a short copper pipe.

Each electrical wiring material shown in FIGS. 16 and 17 is connected by inserting the electrical connection piece 36 into the pipe-like connector 7 similar to that in FIG. 12.

Figure 18:
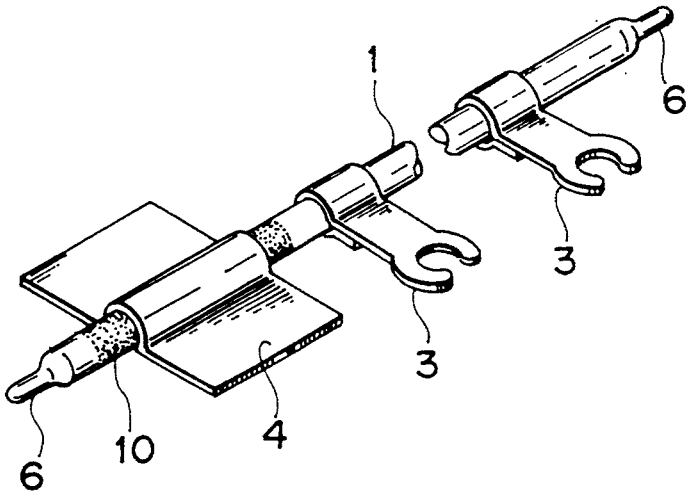
FIGS. 18 and 19 are fragmentary perspective views showing electrical wiring materials as yet further embodiments of the present invention, respectively.

FIG. 18 shows a modification of the electrical wiring material of FIG. 3. On the hollow conductive body 1 made of a long copper pipe having the seal portion 6 formed at its both ends, the bifurcated electrical connection piece 3 is mounted by welding or another means at a position close to both end portions therefor. The radiation plate 4 is mounted between the seal portion 6 of one end portion of the hollow conductive body 1 and the electrical connection piece 3 through the insulating covering 10.

Figure 19:
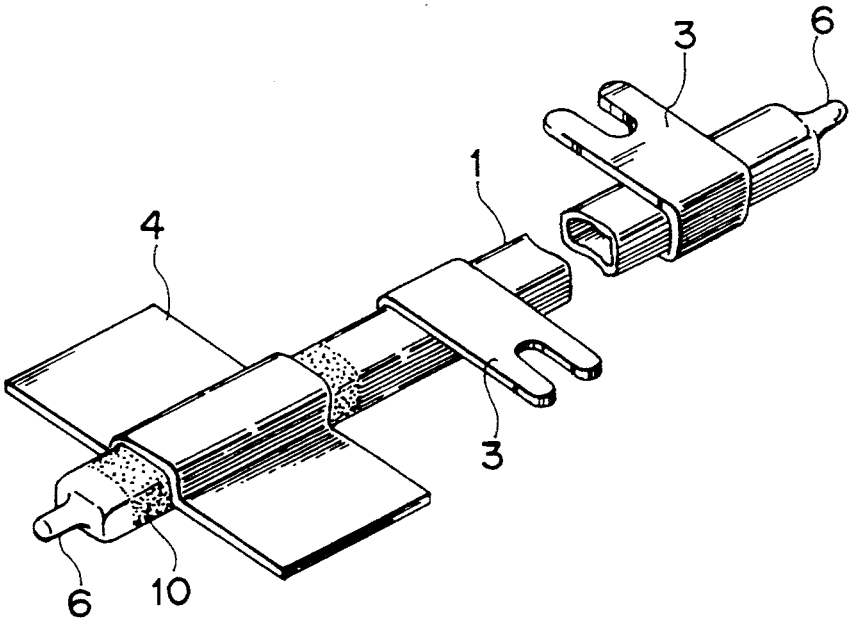

FIG. 19 shows a yet further modification of the electrical wiring material of FIG. 3. On the hollow conductive body 1 made of a long copper rectangular pipe having the seal portion 6 formed at its both ends, the electrical connection piece 3 is mounted by welding or other means at a position close to both end portions thereof. The radiation plate 4 is mounted between the seal portion 6 at one end portion of the hollow conductive body 1 and the electrical connection piece 3 through the insulating covering 10.

In the electrical wiring material of FIGS. 18 and 19, an unshown wick is formed in the hollow conductive body 1, and at the same time, a proper amount of operating fluid is sealed therein. Then, these electrical wiring materials can be used for a coil on the low voltage side of a transformer similar to the electrical wiring material of FIG. 3 and also used in a manner similar to the electrical wiring material of FIG. 1.

Also, in the electrical wiring materials of FIGS. 18 and 19, the electrical connection piece 3 may be replaced with the electrical connection piece naming an annular, hook-like or other form.

As described above, the electrical wiring material of the present invention can be used as cooling means for the heating portions in electronic apparatuses. The transformer of the present invention can also cool the heat generated in the coil on the low voltage side thereof by itself.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

We claim:

1. An electrical wiring material, comprising:

a hollow conductive body having an elongated length;

an operating fluid confined within said hollow conductive body;

said hollow conductive body being deformed at at least one location along said length therewith to define in said hollow conductive body a flattened electrical connection piece at said at least one location; and a remainder of said hollow conductive body including at least one hollow segment, said at least one hollow segment being bounded on at least one side by said electrical connection piece.

2. The electrical wiring material according to claim 1, wherein said electrical connection piece has at least one of bifurcated, annular, cylindrical and channel-like shape.

3. The electrical wiring material according to claim 1, wherein said at least one electrical connection piece is disposed at each of opposite ends of said hollow conductive body.

4. The electrical wiring material according to claim 3, wherein said electrical connection piece includes means for confining said operating fluid within said hollow conductive body.

5. The electrical wiring material according to claim 1, wherein said hollow conductive body has an external insulating means disposed at least partially along said length and around said at least one remaining hollow segment.

6. The electrical wiring material according to claim 1, wherein a substantial portion of said at least one hollow segment has at least one of a square, rectangular, circular and elliptical cross-sectional shape.

7. The electrical wiring material according to claim 1, wherein a radiation plate is disposed at a position along said at least one hollow segment.

8. The electrical wiring material according to claim 1, further comprising:

a wick disposed within said hollow conductive body.

9. A transformer, comprising:

a hollow conductive body having an elongated length;

an operating fluid confined within said hollow conductive body;

said transformer including a low voltage side wound with said hollow conductive body.

10. The transformer according to claim 9, wherein said conductive body has an external insulating means disposed at least partially along said length and around said at least one remaining hollow segment.

11. A transformer, comprising:

a hollow conductive body having an elongated length;

an operating fluid confined within said hollow conductive body;

said hollow conductive body being deformed at at least one location along said length therewith to define in said hollow conductive body a flattened electrical connection piece at said at least one location; and a remainder of said hollow conductive body including at least one hollow segment, said at least one hollow segment being bounded on at least one side by said electrical connection piece.

a one portion of said at least one hollow segment being included in the windings of a low voltage side of said transformer.

12. The transformer according to claim 11, wherein said at least one electrical connection piece is disposed at each of opposite ends of said hollow conductive body.

13. The transformer according to claim 11, further comprising a radiation plate disposed along an unwound portion of any one of said at least one hollow segment.

14. The transformer according to claim 11, wherein said conductive body has an external insulating means disposed at least partially along said length and around said at least one remaining hollow segment.

* * * * *